US006202281B1

(12) United States Patent
Semenov et al.

(10) Patent No.: US 6,202,281 B1
(45) Date of Patent: Mar. 20, 2001

(54) METHOD FOR PRODUCING MULTILAYER THIN-WALLED BELLOWS

(75) Inventors: Viktor Nikonorovich Semenov, Moskovskaya oblast Khimki; Alexandr Konstantinovich Tretiakov; Gennady Grigorievich Derkach, both of Moscow; Vladimir Konstantinovich Chvanov, Moskovskaya oblast Khimki; Jury Vasilievich Movchan, Moskovskaya oblast Khimki; Mikhail Ivanovich Zykov, Moskovskaya oblast Khimki; Valentin Georgievich Polushin, Moskovskaya oblast Khimki, all of (RU)

(73) Assignee: Otkrytoe Aktsionernoe Obschestvo "Nauchno-Proizvodstvennoe Obiedinenie "Energomash" Imeni Akademika V.P.Glushko", Moskovskaya oblast (RU)

( * ) Notice: Subject to any disclaimer, the term of this patent is extended or adjusted under 35 U.S.C. 154(b) by 0 days.

(21) Appl. No.: 09/391,192

(22) Filed: Sep. 7, 1999

(30) Foreign Application Priority Data

Feb. 4, 1999 (RU) ..... 99102069

(51) Int. Cl.[7] ..... B23P 19/04
(52) U.S. Cl. ..... 29/454; 148/528
(58) Field of Search ..... 29/454; 148/528, 148/534, 537

(56) References Cited

U.S. PATENT DOCUMENTS

| | | | | |
|---|---|---|---|---|
| 2,797,112 | | 6/1957 | Ziebold . | |
| 3,782,156 | | 1/1974 | Panfill . | |
| 4,041,969 | * | 8/1977 | Acomb et al. | 137/88 |
| 4,046,596 | * | 9/1977 | Metcalfe et al. | 148/522 |
| 4,116,723 | * | 9/1978 | Gell et al. | 148/555 |
| 4,740,866 | * | 4/1988 | Kajiwara et al. | 361/702 |
| 4,796,632 | * | 1/1989 | Yonezawa et al. | 148/675 |
| 5,244,515 | * | 9/1993 | Miglin | 148/675 |
| 5,250,172 | * | 10/1993 | Vargas-Gutierrez et al. | 205/70 |
| 5,261,319 | * | 11/1993 | Laville et al. | 92/47 |
| 5,413,752 | * | 5/1995 | Kissinger et al. | 419/28 |
| 5,665,180 | * | 9/1997 | Seetharaman et al. | 148/527 |
| 5,951,792 | * | 9/1999 | Balbach et al. | 148/527 |
| 6,036,791 | * | 3/2000 | Mitsuhashi et al. | 148/404 |
| 6,054,096 | * | 4/2000 | Duhl et al. | 420/448 |

FOREIGN PATENT DOCUMENTS

| | | |
|---|---|---|
| 1076166 | 2/1984 | (RU) . |
| 1292870 | 2/1987 | (RU) . |

OTHER PUBLICATIONS

V.D. Korsakov, "Reference Book of Foreman at Die Making", Leningrad, 1972, p. 122.

* cited by examiner

*Primary Examiner*—I Cuda Rosenbaum
*Assistant Examiner*—Marc Jimenez
(74) *Attorney, Agent, or Firm*—Birch, Stewart, Kolasch & Birch, LLP

(57) ABSTRACT

A method includes the round billet skelping, several runs of each round billet drawing up to a given size, packing the drawn billets into a multilayer bank, corrugating the bank with the bellows formation as a result and its heat treatment. Each round billet is skelped of the age-hardenable nickel alloy containing components of the following group: niobium, aluminum, titanium, tungsten and molybdenum. Each round billet is drawn, heated up to the temperature of 1000–1130° C., held in the shielding medium at the above temperature, and cooled down, after that the above operations of drawing, heating, holding and cooling are repeated until the given size of each round billet is reached. The drawn round billets are packed into the multilayer bank and the bank is corrugated for forming the multilayer bellows. The heat treatment of the bellows is made by its heating up to the temperature of 1000–1130° C., holding in the shielding medium at this temperature until the strengthening phase is completely dissolved in the alloy and subsequent cooling down to the temperature of the phase transition termination in the alloy. A rarefied air medium or argon are used as the shielding medium.

8 Claims, No Drawings

METHOD FOR PRODUCING MULTILAYER THIN-WALLED BELLOWS

FIELD OF THE INVENTION

The invention relates to a method for producing a multilayer thin-walled bellows, operating under the conditions of high temperature, high pressure and corrosive media.

BACKGROUND OF THE INVENTION

Multilayer thin-walled metal bellows are widely used in different engineering fields, in aircraft industry, engine manufacturing, and oil industry, for example, for securing a movable joint for the pipelines required for compensating their displacement as a result of external actions, in particular.

Different methods for producing the multilayer thin-walled bellows are known. Fabrication of multilayer bellows of separate thin plates by a welding is described in the U.S. Pat. No. 2,797,112 the U.S. Cl. 72-59, 1959. However, the known method is rather laborious and requires additional testing for securing the reliable operation of these bellows.

A method for producing thin-walled bellows is presented in the U.S. Pat. No. 3,782,156 the U.S. Cl. 72-59, 1974. This method consists of preliminary formation of turns on the external and internal surfaces of round billets, treatment of their internal surface by a roller, compaction with the formation of corrugations and heat treatment for the metal stress-relief. But the known technology requires special complicated equipment and much time for producing a bellows.

The USSR Inventor's Certificate No. 1076166 Int. Cl. B 21 D 15/00, 1984 proposes to make bellows by a mechanohydraulic skelping with the formation of ring corrugations on a round billet at subsequent subrecrystallization annealing at a temperature of 680±10° C. This method allowed a reduction of labor input during the fabrication and a raise in the operational reliability of the bellows.

The USSR Inventor's Certificate No. 1292870 Int. Cl. B 21 D 15/00, 1987 describes a method for producing a multilayer thin-walled bellows of stainless steel, including skelping round billets, several runs of each round billet drawing up to a given size, packing the drawn round billets into a multilayer bank, corrugating the bank with the bellows formation as a result and its heat treatment. According to the known method, the round billets are deformed by drawing through the matrix using the punches, their diameter changes, then the billets are inserted one into another, forming the bank, and corrugated with subsequent operations of surface deformation and heat procession—subrecrystallization annealing.

The operation of drawing each round billet before their packing allowed to increase a product quality due to the strength growth at repeated loading.

However, when alloys undergoing structural variations at heating, age-hardenable nickel-based alloys for example, are used as materials for round billets, such deformations as cracks on the billet walls are possible during their drawing and corrugating due to the low ductility of these alloys. Besides, because of the high tendency to oxidation being characteristic to alloys, there is a possibility for having such defects as cracks and faulty fusions in the bellows made of them at their welding with fittings. This fact limits the use of such bellows under the conditions of high temperature, high pressure and corrosive media during a long time period.

SUMMARY OF THE INVENTION

The object of the present invention is to provide a method for producing a multilayer thin-walled bellows of the age-hardenable alloys on the nickel base, capable of operating under extreme conditions, gas oxidizing medium at high temperature and pressure for example, for a long period of time.

Prevention of crack formation in the walls of round billets and bellows is the technical result of this invention.

This object is achieved by a method for producing a multilayer thin-walled bellows, comprising skelping round billets, several runs of each round billet drawing up to a given size, packing the drawn round billets into a multilayer bank, corrugating the bank with the multilayer bellows formation as a result and heat treating the multilayer bellows. According to the invention each round billet is skelped of an age-hardenable nickel alloy containing a strengthening phase, after drawing each billet is heated up to the temperature of 1000–1130° C., held in a shielding medium at the above temperature until the strengthening phase is completely dissolved in the alloy, and cooled down to a temperature of the phase transition termination in the alloy, after that the above operations of drawing, heating, holding and cooling are repeated until the given size of each round billet is reached and are exercised the packing drawn round billets into the multilayer bank, welding the multilayer bank from two sides over its end faces and corrugating the bank for forming the multilayer bellows, the heat treatment of the bellows is made by its heating up to the temperature of 1000–1130° C., holding in the shielding medium at this temperature until the strengthening phase is completely dissolved in the alloy and subsequent cooling down to the temperature of the phase transition termination in the alloy.

A rarefied air medium under the pressure of $1\times10^{-4}$–$1\times10^{-3}$ mm of the mercury column may be used as the shielding medium.

The cooling of round billet and bellows may be made in an inert gas flow.

Argon may be used as the inert gas.

Niobium, titanium, tungsten and molybdenum may be used as the strengthening phase.

A layer of nickel of 5–15 $\mu$m in thickness may be applied onto peripheral parts of external and internal surfaces of each drawn round billet before the corrugation of the multilayer bank of the round billets.

The round billets of age-hardenable nickel alloy are subjected to the multiple drawing, the billets being heat treated after each drawing operation in the shielding medium at a temperature of the strengthening phase complete dissolving in the alloy with subsequent cooling securing a single-phase structure formation in it. The nickel layer is applied to the peripheral parts of the external and internal surfaces of the round billets, the billet is corrugated after that for forming the bellows that is heat treated according to a procedure of heat treating the billets after each drawing operation. The said operations are typical for producing single-layer thin-walled bellows also.

In this case, the cracking of the round billet walls during each operation on drawing and of the bellows walls at its corrugation is prevented due to the alloy ductility increase, and its oxidizing during the bellows welding to the fittings is prevented also due to the presence of a protective coating on its walls resulting in the growth of the unit strength during the operation.

DETAILED DESCRIPTION OF THE INVENTION

According to the invention, the proposed method is implemented in the following way.

The round billets of age-hardenable nickel alloy are subjected to drawing using a die. The drawing is made in several runs, the number of which depends on the ratio of the billet length to its diameter. The last drawing run results in obtaining the thin-walled round billet of the given size.

The billet is subjected to the heat treatment in a furnace after each drawing run. The heating is provided up to the temperature of 1000–1130° C., at which is provided dissolving of such alloy components as titanium, niobium, tungsten, molybdenum, etc., being used as a strengthening phase. The holding is made in vacuum or in the inert gas medium. A single-phase alloy structure is provided by cooling, using the inert gas flow. The temperature mode depends on the chemical composition of the alloy. The said heat treatment allows to increase the age-hardenable alloy ductility due to securing a single-phase structure, while the heat treatment after each drawing run restores the alloy to the initial ductility state required for forging. Operations of the drawing and heat treatment are repeated several times depending on sizes and materials of the round billets. The billets with the wall thickness of 0.1–0.16 mm are obtained.

The obtained billets are covered by the layer of nickel with the thickness of 5–15 $\mu$m. The covering is applied onto the peripheral parts of both external and internal surfaces of the round billets, these parts being subsequently used for welding a bellows to fittings. A nickel layer of less than 5 $\mu$m in thickness would not protect the welded joint against oxidizing during the bellows welding to fittings, while a layer of more than 15 $\mu$m in thickness would change the chemical composition of the weld, and this may result in the reduction of its strength during the operation. The covering is applied by a method of electroplating. The round billets are assembled into the multilayer bank. The bank is welded from the sides over its end faces and is corrugated using a press, and the bellows is formed as a result. The process proceeds at a pressure determined experimentally depending on a given stress and corrugation size. After the corrugation, the obtained bellows is heat treated according to a heat treatment procedure used for the round billets after each drawing run, i.e. the heating and drawing are made at a temperature of the strengthening phase complete dissolving in the alloy with subsequent cooling which provide the formation of the single-phase structure in it. Such heat treatment allows relieving internal stresses in the bellows and excluding the possible defects in it.

The method of the present invention is applicable for making both single-layer bellows produced of a single round billet, and multilayer bellows produced of several, at least two, round billets inserted one into another owing to the difference in given diameters.

The examples of implementing the method for producing a multilayer bellows are presented hereafter.

The bellows were made of the age-hardenable alloys based on nickel-chromium and such alloy components as niobium, titanium, aluminum, tungsten, molybdenum, etc. The above alloy components form the strengthening phase.

EXAMPLE 1

A round billet with the thickness of 1 mm and diameter of 75 mm made of an age-hardenable nickel alloy containing niobium and titanium as the alloy strengthening phase was subjected to drawing from a plate using a punch with the drawing coefficient 0,62. The obtained round billet was heated in a vacuum furnace at rarefaction of $1\times10^{-4}$–$1\times10^{-3}$ mm of the mercury column up to the temperature of 1000° C. and held until complete dissolving of the strengthening phase. Then it was cooled by an argon flow for securing a single-phase structure of the alloy. The gas feed was stopped and further cooling was made in the zone of argon stagnation. A second drawing run with a coefficient of 0,8 was made after the heat treatment, after which the round billet was heat treated again according to the procedure presented above. The drawing runs and operations on heat treatment were repeated 15 times until a round billet of the following given sizes are obtained:

wall thickness—0,16 mm, external diameter—62 mm.

Three round billets more were treated in the same way, but with the other resultant given diameters: 60, 58, and 56 mm correspondingly.

Four round billets subjected to such skelping were electroplated with nickel. The layers of 5 $\mu$m in thickness were applied onto the peripheral parts of both surfaces of each round billet, excluding the external surface of the billet with maximum diameter and the internal surface of the billet with minimum diameter, the peripheral parts being subsequently used for welding to the fittings. The external surface of the billet with maximum diameter and the internal surface of the billet with minimum diameter were covered by a nickel layer of 15 $\mu$m in thickness. The round billets with a nickel covering were assembled into the multilayer bank, inserting the billets one into another. The bank was welded from two sides over its end faces and corrugated by a single action of a press. The process proceeded under the pressure of 145 atm. The shaped bellows was subjected to a heat treatment. It was heated in a furnace up to a temperature of 1000° C. in argon medium and cooled by an argon flow after holding.

A liquid-penetrant test was made for revealing cracks after each drawing run and after the corrugation. No cracks in the billet walls and the corrugated bellows walls were detected at all test stages. Cracks were not detected also in the weld after the bellows welding to fittings. After their welding to the fittings, the bellows produced by the above method were durable strength tested in the high-temperature gas flow containing up to 80% of oxygen. These tests showed that the strength properties of construction degraded later than it is stated by specification, namely in 4 hours at a norm of no less than 3 hours.

EXAMPLE 2

Four round billets of nickel alloy, containing the same components as in the Example 1, of 1.0 mm in thickness and 165 mm in diameter were subjected to drawing using a punch with the drawing coefficient of 0.693. The round billets obtained were heat treated according to the procedure of Example 1. The drawing runs and heat treatment operations were repeated 15 times until the billets of 550 mm in length, and 88, 85, 82 and 79 mm in diameter, correspondingly, were obtained. The wall thickness of these billets was 0,16 mm. The temperature of heating and holding during the heat treatment was 1130° C. The skelped billets were covered by a layer of nickel, that was applied onto the peripheral parts of the surfaces in a way described in the Example 1. The multilayer bank of the billets was welded from two sides over its end faces and corrugated by a single action of the press. The process was made under the pressure of 145 atm. The formed bellows was heat treated in accordance with the procedure described above.

Tests were made for revealing cracks after each drawing run, after the billet package corrugation and after the bellows welding to fittings. No cracks were discovered in the bellows billet walls and in the weld. Durable strength test was conducted similarly to the Example 1. The strength properties degraded after 4,5 hours at a norm of no less than 3 hours.

Thus, the indicated technical result was achieved due to the use of a combination of heat treatment both for the round billets and for the bellows, and application of protective coating onto its walls.

The invention being thus described, it will be obvious that the same may be varied in many ways. Such variations are not to be regarded as departure from the spirit and scope of the invention, and all such modifications as would be obvious to one skilled in the art are intended to be included within the scope of the following claims.

We claim:

1. A method for producing a multilayer thin-walled bellows, comprising the steps of:

skelping round billets of an age-hardenable nickel alloy, containing a strengthening phase;

said skelping round billets, including skelping each round billet with external and internal surfaces, having peripheral parts;

drawing each said round billet;

heating each said round billet up to a temperature of 1000–1130° C.;

holding each said heated round billet in a shielding medium of the above temperature until said strengthening phase is completely dissolved in said alloy;

cooling each said held round billet down to the temperature of a phase transition termination in said alloy;

repeating said steps of drawing, heating, holding and cooling until a given size of each said round billet is reached;

packing said drawn round billets into a multilayer bank, having end faces;

welding said multilayer bank from two sides over said end faces;

corrugating said multilayer bank for forming said multilayer bellows; and heat treating said multilayer bellows, including its heating up to the temperature of 1000–1130° C., holding in said shielding medium at this temperature and subsequent cooling down to the temperature of said phase transition termination in said alloy.

2. The method according to claim 1, wherein said shielding medium is rarefied air medium under a pressure of $1\times10^{-3}$–$1\times10^{-3}$ mm of a mercury column.

3. The method according to claim 1, wherein said cooling the round billet and the bellows is made in an inert gas flow.

4. The method according to claim 3, wherein said inert gas is argon.

5. The method according to claim 1, wherein said shielding medium is an inert gas.

6. The method according to claim 5, wherein said inert gas is argon.

7. The method according to claim 1, wherein said strengthening phase are elements selected from the group consisting of niobium, titanium, tungsten and molybdenum.

8. The method according to claim 1, wherein a layer of nickel of 5–15 $\mu$m in thickness is applied onto said peripheral parts of said external and internal surfaces of each said drawn round billet before said corrugation of said multilayer bank of said round billets.

* * * * *